United States Patent [19]

Metzner

[11] 4,270,278

[45] Jun. 2, 1981

[54] WIND VECTOR RESOLUTION DEVICE

[76] Inventor: Robert G. Metzner, 916 N. Foothill, Beverly Hills, Calif. 90210

[21] Appl. No.: 102,778

[22] Filed: Dec. 12, 1979

Related U.S. Application Data

[63] Continuation of Ser. No. 901,594, May 1, 1978, abandoned.

[51] Int. Cl.[3] ..... B43L 7/06

[52] U.S. Cl. ..... 33/457; 33/453; 33/463

[58] Field of Search ..... 33/1 SB, 453, 457, 460–463

[56] References Cited

U.S. PATENT DOCUMENTS

| | | | |
|---|---|---|---|
| 1,117,805 | 11/1914 | De L'eau | 33/453 |
| 2,210,939 | 8/1940 | Garrett | 33/453 |
| 2,300,347 | 10/1942 | Dalton | 33/453 |
| 3,863,347 | 2/1975 | Banner | 33/453 |

*Primary Examiner*—Charles E. Phillips

*Attorney, Agent, or Firm*—Lyon & Lyon

[57] ABSTRACT

The disclosure teaches a device for creating an infinite number of vector triangles such that a vehicle's speed may be set as one leg of a vector triangle and the apparent wind's speed and direction may be set as a second leg, solution of the third leg yielding true wind speed and relative wind direction which is convertible into true wind direction by reference to vehicle true heading.

5 Claims, 3 Drawing Figures

WIND VECTOR RESOLUTION DEVICE

This is a continuation of application Ser. No. 901,594, filed May 1, 1978 now abandoned.

BACKGROUND OF THE INVENTION

1. Field of the Invention

The invention is specifically designed for use in sailboat racing applications where true wind speed and direction are desired for purposes of planning proper sail utilization on the next tack. However, the device has applications in any wind powered vehicle and may be useful for navigation in airplanes.

2. Description of the Prior Art

The prior art teaches various devices capable of forming an infinite number of triangles. However, enclosing such a device in a weatherproof box and provided external controls for varying the triangle is not taught. Many of the devices taught also must be used on flat stable surfaces so that pitch and roll of a sailing vessel in heavy seas would interfere with use of the device or make it more difficult.

For example, in Banner, U.S. Pat. No. 3,863,347, a navigation device capable of forming an infinite number of triangles is taught but no weatherproof enclosure with external controls is specified or claimed. Also, the device has 4 arms instead of 3 and is used for a different purpose, i.e., to determine the effect of wind and current on the course of a moving vessel. This is an entirely different problem than solved by the present invention.

In Klauberg, U.S. Pat. No. 3,486,232, a device is taught to form an infinite number of triangles and which could be used for the same purpose as the present invention. The device can measure the length of each side of the triangle and the angle between each pair of sides. However, the device would have to be used on a flat stable surface. The construction taught leaves the sides free at all times to slide to new unwanted settings. Further, the scales used on the Klauberg device are not suitable for solution of the wind vector problem. Only two sides in the present invention move on trackways, not all three. Finally, there are gradations on only one moving arm in the present invention and another side is measured by means of a scale on a gear engaging that side and enabling its adjustment.

In Gabriel, U.S. Pat. No. 3,083,901, a device is taught that can solve right and oblique triangles. However, the device does not teach a weatherproofenclosure nor external knobs for controlling the setting of various sides.

BRIEF SUMMARY OF THE INVENTION

The invention is comprised basically of two adjustable members linked together. The length of one may be varied representing the boat speed. The length and angle of the other may be varied to represent the apparent wind direction and speed relative to the vehicle. A third member is connected to the first two such that no matter what their relationship, the third member will complete a triangle.

It is the principal object of this invention to allow resolution of a vector triangle of two known vectors into a vector representing true wind speed and relative wind direction such that sail planning may be made for the next tack in a sailboat race.

It is another object of this invention to allow compensation for drift caused by wind in navigation of planes and boats.

FIG. 3 is a diagram of a typical vector triangle of the type resolved in this invention.

DETAILED DESCRIPTION OF THE PREFERRED EMBODIMENT

In the preferred embodiment, the vectors are enclosed in a weatherproof frame enclosure 25 and are operated by exterior knobs and levers so that the device may be operated without damage in rough seas.

Figure 1:
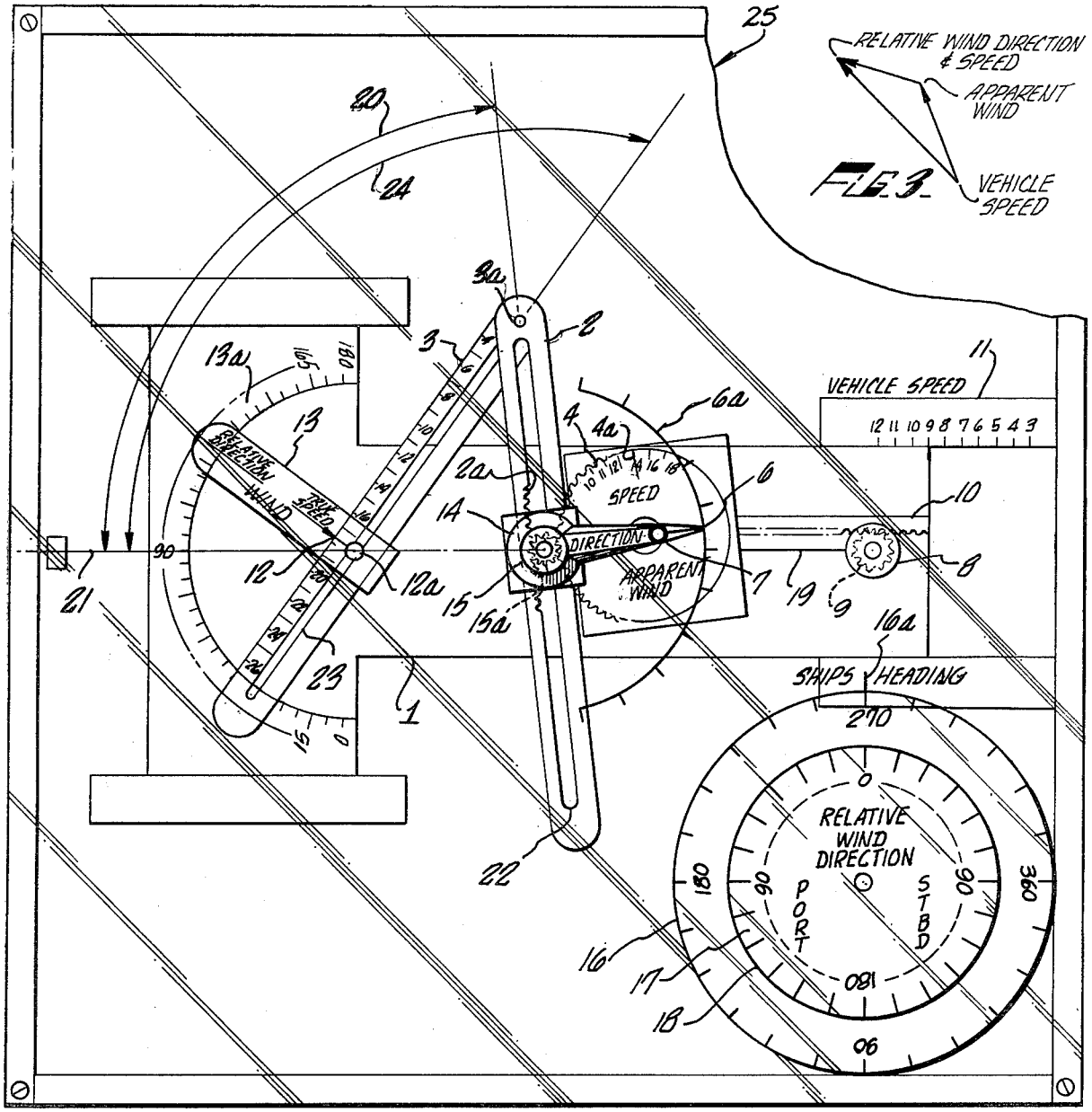
FIG. 1 is a plan view of the preferred embodiment of the invention.

Referring to FIG. 1, sliding block 1, rack carrier 2, and graduated member 3 form a vector triangle which is adjustable into an infinite number of triangles. The distance between pin 12*a* and shaft 15*a* represents boat speed. Pin 12*a* is connected to sliding block 1. Shaft 15*a* passes through slot 19 in sliding block 1 and is affixed to frame enclosure 25.

The length of rack carrier 2 from shaft 15*a* to pivot 3*a* represents the apparent wind speed. The angle 20 between rack carrier 2 and the centerline 21 of sliding member 1 represents the apparent wind direction.

Apparent wind speed is indicated by the point on the speed scale calibrated on the face of apparent wind speed scale 4 under cursor 4*a*. The apparent wind speed scale 4 is a gear which meshes with rack carrier pinion gear 15. The rack carrier pinion gear 15 engages a rack of gear teeth 2*a* in a slot 22 in rack carrier 2. Rack carrier pinion gear 15 is turned by apparent wind velocity knob 14.

The angle 20 of rack carrier 2 relative to sliding block 1 represents the direction of the apparent wind. This angle is indicated by direction pointer 6 on protractor scale 6*a*. Direction pointer 6 is affixed to rack carrier 2 and pivots around shaft 15*a*.

Graduated member 3 is connected to rack carrier 2 at pivot 3*a*. Therefore, adjustment of either apparent wind velocity knob 14 or direction pointer 6 will cause graduated member 3 to move relative to pivot 12*a* which passes through a slot 23 in graduated member 3 and is affixed to sliding block 1.

Vehicle speed knob 8 is connected to sliding block pinion gear 9. This gear engages rack 10 which is affixed to sliding block 1. Rotation of vehicle speed knob 8 causes sliding block 1 to move relative to vehicle speed scale 11 affixed to frame enclosure 19. Pin 12*a* is connected to sliding block 1 but shaft 15*a* is not connected to sliding block 1 therein. Because of this arrangement, movement of sliding block 1 will cause movement of graduated member 3 about pivot 12*a*.

Figure 2:
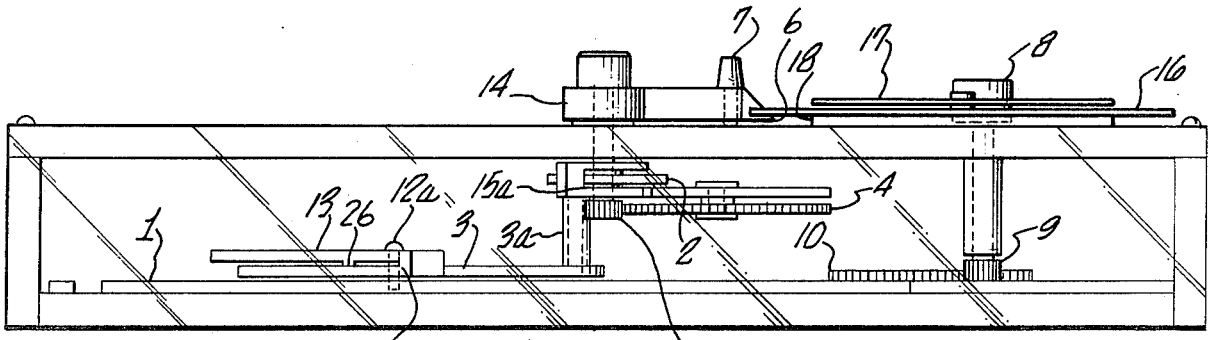
FIG. 2 is an elevation view of this embodiment.

The length of graduated member 3 between pin 12*a* and pivot 3*d* represents true wind speed. Indicator 13 is connected to pin 12*a* and graduated member 3 such that it will indicate angle 24 between graduated member 3 and the centerline 21 of sliding block 1. Indicator 13 includes a channel defined by legs 26 and 27 as can be seen in FIG. 2 in which graduated memer 3 slides, the indicator 13 being pivotally held by the pin 12*a*. Angle 24 is indicated on relative wind direction protractor scale 13*a*. Cursor 12 on indicator 13 indicates true wind speed on the wind speed scale calibrated on graduated member 3.

True wind direction is derived from relative wind direction indicated on relative wind direction protractor scale 13*a* by means of compass rose 16. Compass rose 16 is rotated to indicate the vehicle's true heading at ship's heading cursor 16*a*. The "0" of circular relative wind direction scale 18 is then aligned with ship's heading cursor 16*a*. Relative wind direction as indicated on protractor scale 13*a* is then read along the appropriate scale 17 depending upon whether the relative wind is over the port or starboard beam. True wind direction is then read from the point on compass rose 16 closest to the relative wind direction indication on scale 17.

Although the invention has been described in terms of the specific embodiment described above, other equivalent embodiments are intended to be included.

What is claimed is:

1. A vector resolution apparatus for resolving a known apparent wind velocity vector and a known vehicle velocity vector into a true wind velocity vector, comprising a frame;

a block assembly mounted to said frame for linear translational movement relative to said frame, said block and frame being calibrated such that the position of said block on said frame represents vehicle speed;

an adjustable engagement means on said block and frame for adjustment and retention of the position of said block relative to said frame and including a vehicle speed knob fixed to said adjustable engagement means for effecting said adjustment;

a guide member rotatably mounted to said frame;

a rack carrier slidably mounted to said guide member for linear translational movement and rotational movement relative to said frame to represent the apparent wind vector; and a graduated member pinned at a first point to said rack carrier and slidably pinned at a distance from said first point to said block to represent the true wind vector.

2. The vector resolution apparatus of claim 1 wherein said adjustable engagement means comprises a rack and pinion gear including a first rack located on said block and a first pinion rotatably mounted on said frame.

3. A vector resolution apparatus for resolving a known apparent wind velocity vector and a known vehicle velocity vector into a true wind velocity vector, comprising a frame;

a block slidably mounted to said frame for linear translational movement relative to said frame, said block and frame being calibrated such that the position of said block on said frame represents vehicle speed;

a rack carrier mounted to said frame for linear translational movement and pivotal movement relative to said frame and including a rack fixed to said rack carrier, a pinion rotatably mounted to said frame and engaging said rack for effecting linear translational adjustment of said rack carrier relative to said frame to represent apparent wind speed and a guide member rotatably mounted to said frame coaxially with said pinion, said rack carrier being fixed to rotate with said guide member to represent the apparent wind vector direction; and a graduated member pinned at a first point to said rack carrier and slidably pinned at a distance from said first point to said block to represent the true wind vector.

4. A vector resolution apparatus for resolving a known apparent wind velocity vector and a known vehicle velocity vector into a true wind velocity vector, comprising a frame;

a block assembly mounted to said frame for linear translational movement relative to said frame, said block and frame being calibrated such that the position of said block on said frame represents vehicle speed;

a rack carrier mounted to said frame for linear translational movement and rotational movement relative to said frame to represent the apparent wind vector;

a graduated member pinned at a first point to said rack carrier and slidably pinned at a distance from said first point relative to said block to represent the true wind vector; and a slide pinned to said block, said graduated member being slidably mounted to said slide such that said slide is fixed to rotate with the said graduated member, said slide extending to a protractor for measurement of the true wind vector relative direction.

5. A vector resolution apparatus for resolving a known apparent wind velocity vector and a known vehicle velocity vector into a true wind velocity vector, comprising a frame;

a block slidably mounted to said frame for linear translational movement relative to said frame, said block and frame being calibrated such that the position of said block on said frame represents vehicle speed;

a rack carrier mounted to said frame for linear translational movement and rotational movement relative to said frame and including a rack fixed to said rack carrier, a pinion rotatably mounted to said frame and engaging said rack for effecting linear translational adjustment of said rack carrier relative to said frame to represent apparent wind speed and a guide member rotatably mounted to said frame coaxially with said pinion, said rack carrier being fixed to rotate with said guide member to represent the apparent wind vector direction;

a graduated member pinned at a first point to said rack carrier and slidably pinned at a distance from said first point relative to said block to represent the true wind vector, said graduated member including a slide pinned to said block coaxially with said graduated member; and a slide pinned to said block, said graduated member being slidably mounted to said slide such that said slide is fixed to rotate with the said graduated member, said slide extending to a protractor for measurement of the true wind vector relative direction.

* * * * *